US005947885A

United States Patent [19]

Paterson

[11] Patent Number: 5,947,885

[45] Date of Patent: Sep. 7, 1999

[54] METHOD AND APPARATUS FOR FOLDING SHEET MATERIALS WITH TESSELLATED PATTERNS

[76] Inventor: James G. T. Paterson, P.O. Box 250181, Atlanta, Ga. 30325

[21] Appl. No.: 08/853,492

[22] Filed: May 8, 1997

Related U.S. Application Data

[63] Continuation-in-part of application No. 08/332,889, Nov. 1, 1994, abandoned.

[51] Int. Cl.[6] ..... B21D 5/16; A63H 33/16

[52] U.S. Cl. ..... 493/451; 493/448; 493/955; 493/966

[58] Field of Search ..... 493/451, 456, 493/463, 966, 941, 955, 418, 405, 395, 449, 448, 447

[56] References Cited

U.S. PATENT DOCUMENTS

| | | | |
|---|---|---|---|
| 1,571,105 | 1/1926 | Burdick | 493/451 X |
| 2,709,950 | 6/1955 | Foster et al. | 493/451 |
| 2,826,239 | 3/1958 | Villoresi . | |
| 2,901,951 | 9/1959 | Hochfeld | 493/451 X |
| 2,950,656 | 8/1960 | Gewiss | 493/966 X |
| 3,135,174 | 6/1964 | Gewiss | 493/448 X |
| 4,012,932 | 3/1977 | Gewiss | 493/941 X |
| 5,234,727 | 8/1993 | Hoberman | 428/12 |
| 5,484,378 | 1/1996 | Braithwaite | 493/955 X |

*Primary Examiner*—James F. Coan
*Attorney, Agent, or Firm*—James B. Middleton

[57] ABSTRACT

A variety of sheet materials can be tessellation folded with an infinite variety of patterns in a one-step folding process by placing the sheet material against a pallet having flat rigid segments and flexible hinges, exerting forces against the pallet in accordance with information as to the pattern desired to initiate folding, and continuing folding to the degree of folding collapse wanted. A heat setable material can be heated prior to folding so the material will be set as folded. An uncured cementitious material can be folded, and held in a mold until the material is cured. Due to natural pantographic degradation, a continous belt can be folded in one area, with sheet material to be folded being placed against the belt before folding, and removed as the belt unfolds.

12 Claims, 10 Drawing Sheets

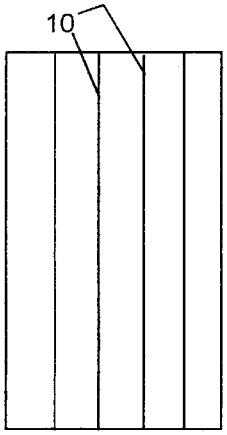
Fig. 1
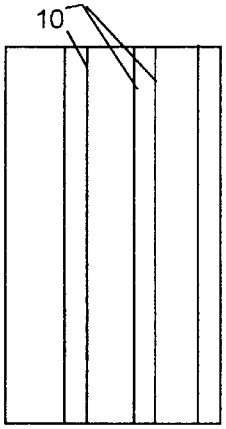
Fig. 2
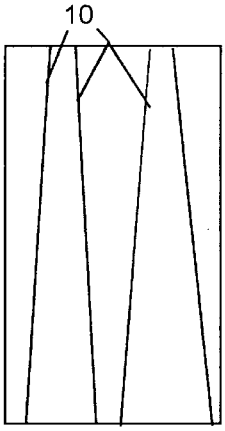
Fig. 3
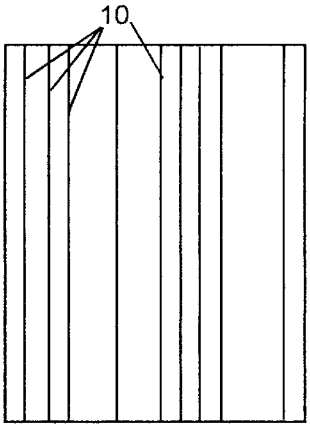
Fig. 4
Fig. 5
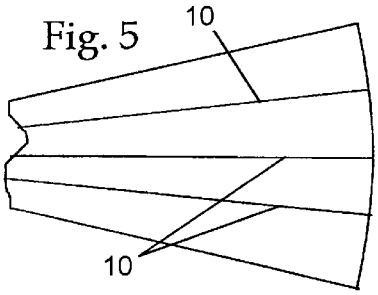
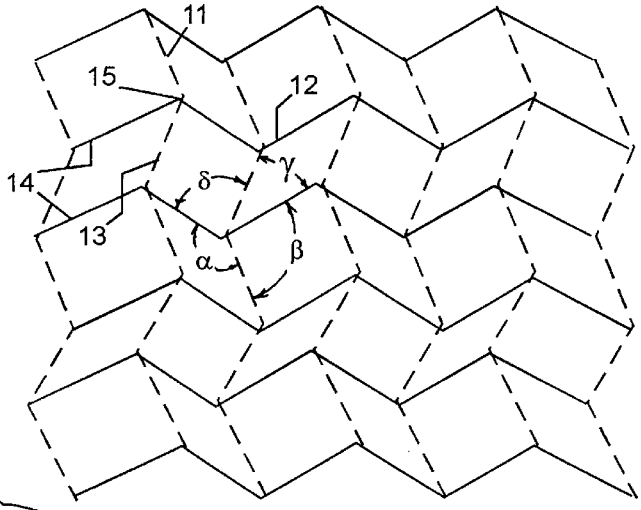
Fig. 6
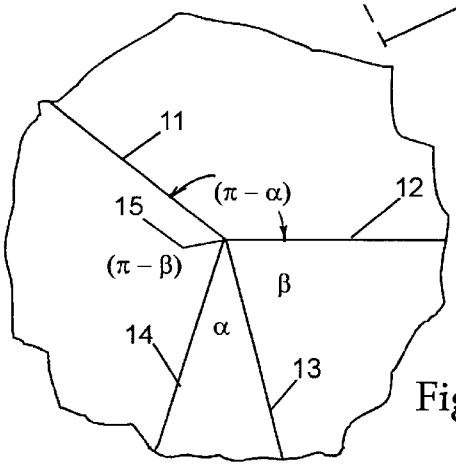
Fig. 7

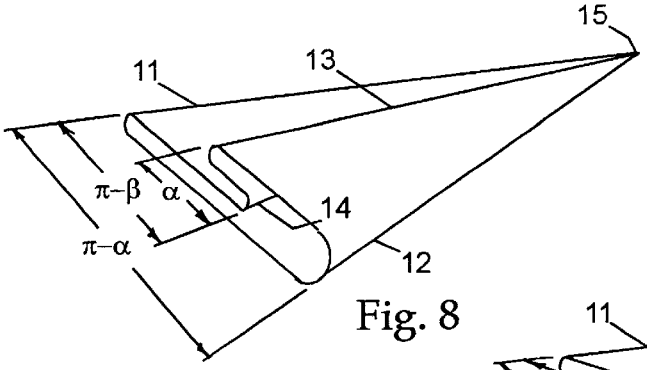
Fig. 8
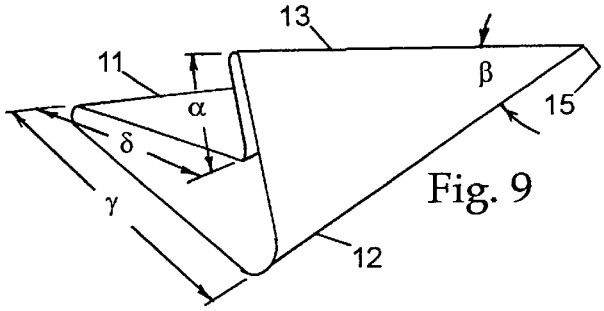
Fig. 9
Fig. 10
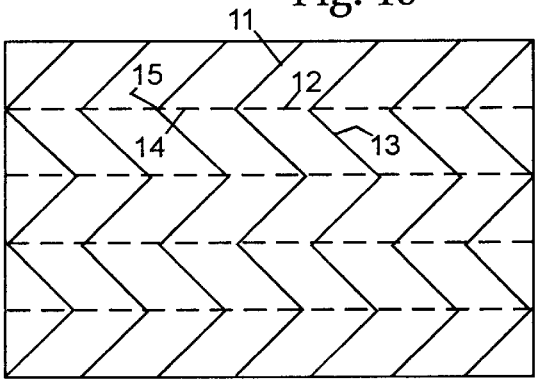
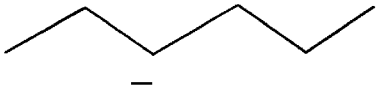
Fig. 11
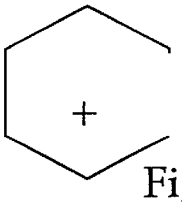
Fig. 12
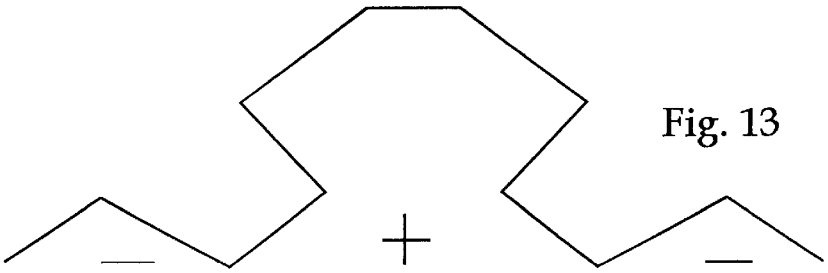
Fig. 13

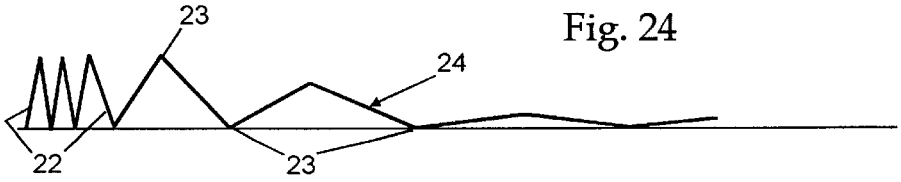
Fig. 24
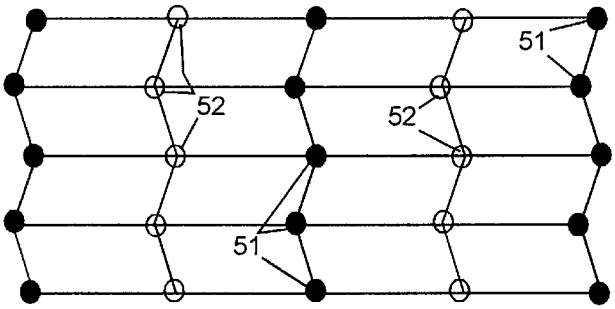
Fig. 25
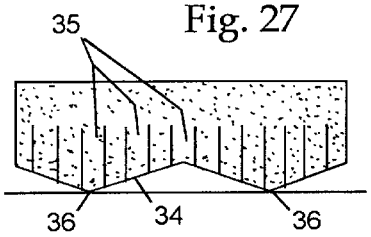
Fig. 27
Fig. 26
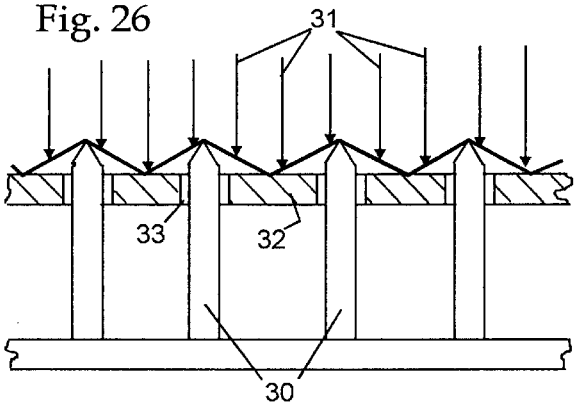
Fig. 28
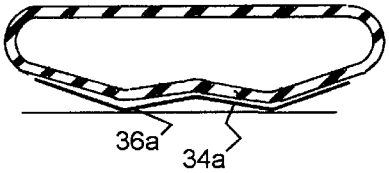
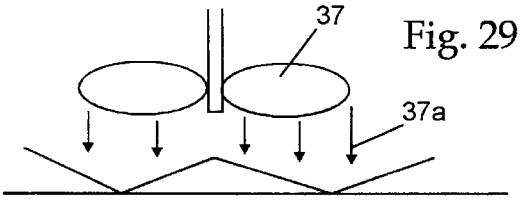
Fig. 29

Fig. 35
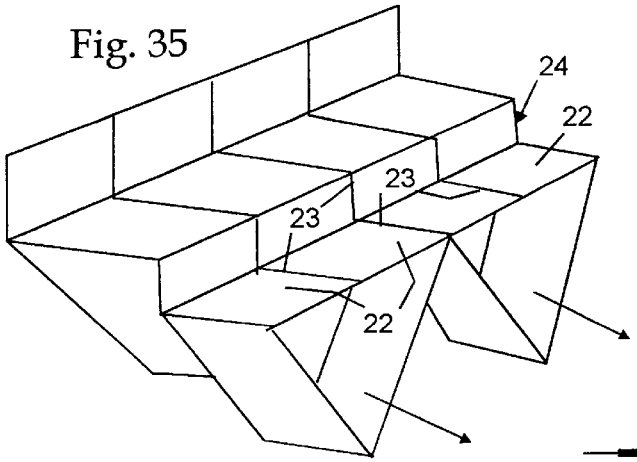
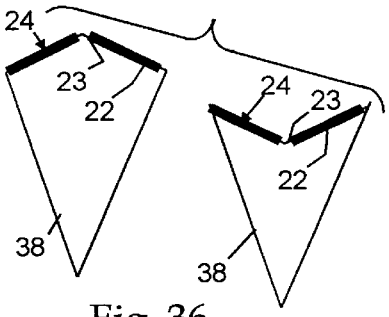
Fig. 36
Fig. 37
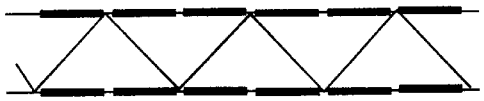
Fig. 38
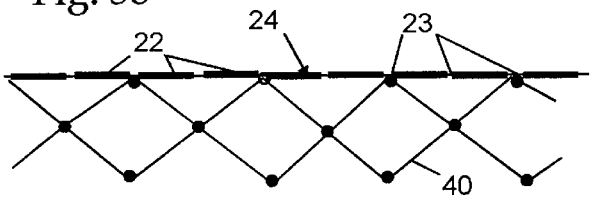
Fig. 39
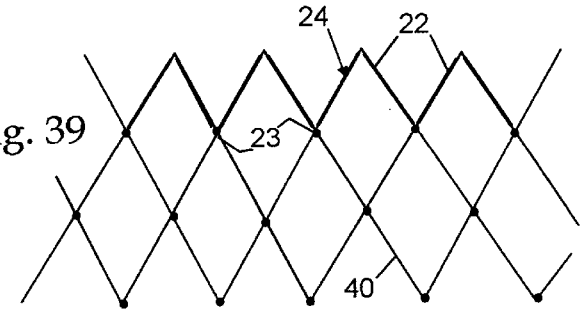
Fig. 40
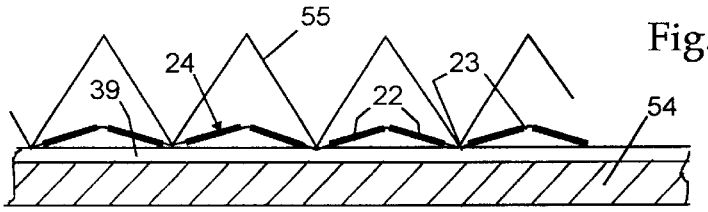

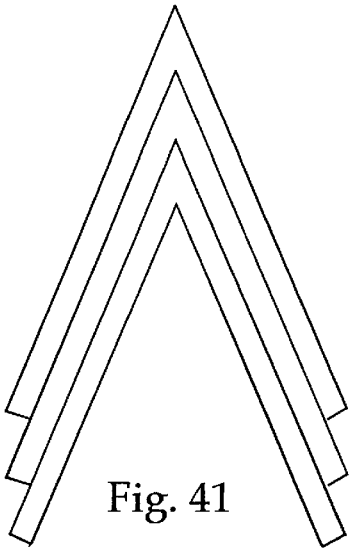
Fig. 41
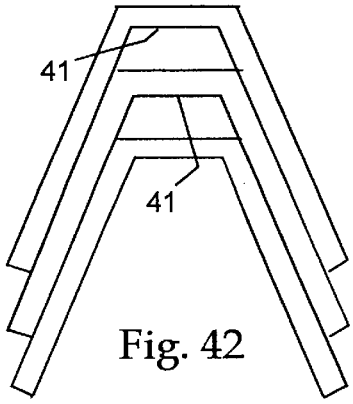
Fig. 42
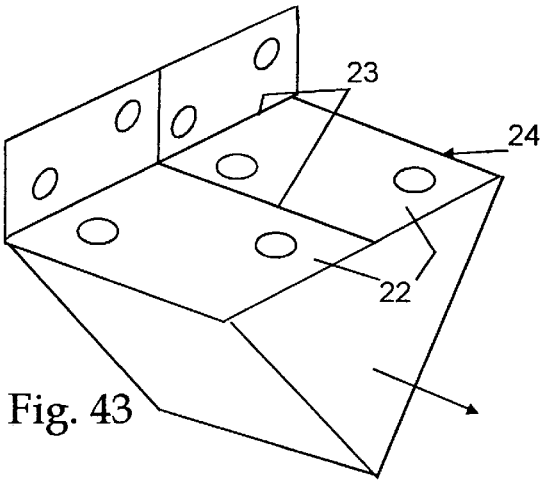
Fig. 43
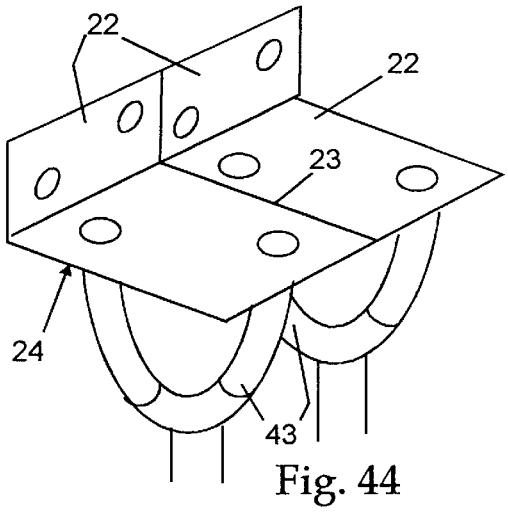
Fig. 44
Fig. 45
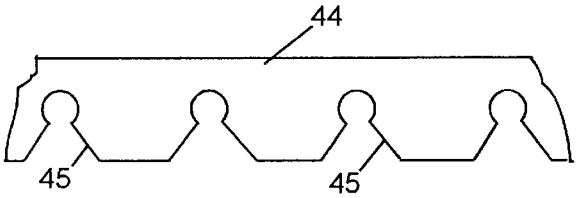
Fig. 46
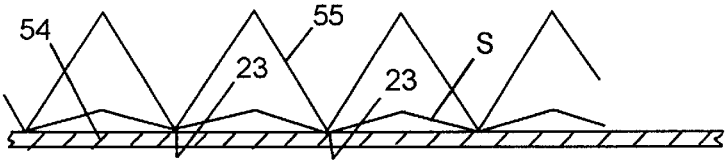

METHOD AND APPARATUS FOR FOLDING SHEET MATERIALS WITH TESSELLATED PATTERNS

CROSS REFERENCE TO RELATED APPLICATION

This application is a continuation-in-part of the copending application of the same inventor, entitled "Method and Apparatus for Folding Sheet Material with Tessellated Pattern", filed on Nov. 1, 1994, and having application Ser. No. 08/332,889, now abandoned.

BACKGROUND OF THE INVENTION

1. Field of the Invention

This invention relates generally to the multiple tessellation folding of sheet materials, and is more particularly concerned with the methodology of and apparatus for folding these patterns in a one step continuous operation.

2. Discussion of the Prior Art

Sheet materials can be tessellation folded in an infinite variety of patterns, and the patterns can be arranged into different classes of patterns. The patterns are best viewed by class, although particular patterns are hybrids, as they involve a combination of classes.

Plaiting is the simplest and best known class of tessellation folding pattern. Most often it is based on a single system of equally spaced parallel folding lines, but more complex plaiting patterns are formed by varying the spacings and/or the inclinations between the folding lines. In general, therefore, plaiting can be defined as a tessellation folding pattern based on a single system of more or less parallel, but continuously straight, folding lines.

Traditionally, craft plaiting is done by placing the sheet material to be folded conjugatively between two master sheets of stiff paper (or like material) which have been previously folded in the plaiting pattern wanted, and have subsequently been opened out. The folds in such master sheets generally retain some weak folding bias which prevents the sheets from being truly flattened out and assists in refolding for several repeat foldings before the folding bias disappears. The sandwich (the two master sheets with the sheet material between them) is manually folded to complete collapse in order to set the folds. Heat may be applied during pressing to heat-set the folds when plaiting certain fabrics.

There are several types of plaiting machines available for plaiting in a production setting.

Tessellation folding patterns of significant interest are more complex than plaiting patterns. They are based on having two systems of more or less parallel folding lines crossing one another, either orthogonally or obliquely; they could also be defined as patterns in which four folding lines meet at each folding focus (or intersection). This form of tessellation patterning is often called "cross plaiting" on the basis of assuming that plaiting takes place independently in each system, and the tessellation pattern developed is an interference pattern generated by meeting of the two plaitings. But the assumption is not entirely valid because, in folding, the two systems are not wholly independent of each other. Even so, as in single system patterning, the spacings and inclinations of the folding lines in each of the systems can be varied.

In triple system tessellation folding, three systems of parallel folding lines intersect. They could also be defined as patterns in which six folding lines meet at each folding focus.

Although the art of single system tessellation folding (plaiting) is of contextual interest, it is well established and known. Thus, references to such art is made only where it has particular relevance, e.g. in hybrid pattern folding.

U.S. Pat. No. 1,571,105 to Burdick discloses a machine for single system folding small sheets of paper (e.g. paper money) by threading the paper between several horizontally disposed contiguous, but untouching, pairs of plates. At each end the plates are mounted on the pivots of chain link pantographs so that, as the chain link pantographs are shortened by compression, the pairs of plates rotate and take up a vertical and closely spaced side-by-side configuration. In so doing, the paper threaded between the plates is plait folded. U.S. Pat. No. 2,709,950 to Foster et al. discloses a machine for tessellation folding a paper tube into a dual system polygonal bellows. It is done by pressing the tube, all at once, with arrays of blades extending along its length, causing folding to take place at the contact locality of each blade. The tube shortens as folding takes place; and, so that the blades move in concert with the tube as it shortens, the blades are mounted on the pivots of a chain link pantograph.

U.S. Pat. No. 2,826,239 to Villoresi, discloses several related methods of making tessellated papers for packaging purposes. These are formed in a two step process. In the first, the paper is run between heated impressing rolls having intermeshing chevron teeth. This gives the paper dual system folding bias so that, in the second step, when the material confined between the sides of a squeeze box is compressed laterally (also transversally in a variant form), varying degrees of dual system tessellation folding is induced. A method of longitudinally scoring of paper, alternately on its top and bottom sides, is also disclosed as a means of enhancing the degree of dual system folding obtained when the material is subjected to compression in the squeeze box.

U.S. Pat. No. 2,901,951 to Hockfeld discloses a two step method of dual system tessellation folding a sheet material by first applying single system folding, and then applying plait shaped dies to upset the pleats to cause them to fold locally with dual system tessellation folding: the dies are applied progressively as the plaited material is passed through the machine.

U.S. Pat. No. 2,950,656 to Gewiss discloses a two step method of progressively applying dual system folding to initially plaited flat and cylindrically shaped sheets. Using a feed, stop and fold repetitive mechanism, die fingers are pressed into the plaits of a single system folding, causing them to cross-fold and form a dual system folding at one set of localities at a time. A related method is also disclosed in which die fingers mounted on the pivots of link chains are inserted between the plaits of a single system folded, but partially extended, sheet material. Cam actuated bars attached to every second pivot in each of the chains ensure that, as the folding and chains are compressed and traversed through the machine, the chain links fold alternately in one direction and then the other, so that the die fingers extending from the chain pivots, cause the plaits to cross plait alternatively also in one direction and then the other, thus forming the dual system folding.

U.S. Pat. No. 3,135,174 to Gewiss discloses the use of two master sheets (made from malleable stiff paper previously folded to the dual system pattern wanted, and then opened out) to tessellation fold in two steps, the pattern on to a sheet material placed conjugatively between them. In the first step the sandwich (the two master sheets with the sheet material between them) is plaited. In the second step the plaiting is compressed longitudinally, causing dual system cross folding to take place, according to the pattern initially put on the master sheets. The patent also discloses applying the same two master sheet, two step tessellation folding method to cylindrically shaped sheets.

U.S. Pat. No. 3,553,423 to Geviss cites the use of one master sheet to perform two step dual system folding of a sheet material, and also of two sheet materials; one is conjugatively placed in contact with one side of the master sheet, and the other with the other side. Varying the thickness of the master sheet to reduce the sharpness of the foldings is also cited.

U.S. Pat. No. 5,234,727 to Hoberman discloses forming complex dual system space enclosing tessellation folding patterns, but does not disclose means of folding them.

While tessellation folding is known in the prior art, and several types of folding machines have been developed, such machines are very limited in the variety of folding patterns that can be made, and they are not very practical. Thus, no simple, broadly applicable means of production has been developed.

SUMMARY OF THE INVENTION

The present invention provides a one step, continuous folding means which does not cause damage to the material being folded, thereby opening up the field of tessellation folding to sheet materials hitherto considered unsuitable for folding. The invention is broadly applicable to the entire field of tessellation pattern folding.

The methods and apparatus of the present invention rely on the phenomenon of compound pantographing wherein succeeding portions of the folding pattern follow folding of the first portions. This will be referred to hereinafter as CPR, for Compound Pantographic Response. Initiation of the folding is essential, and the present invention provides for initiation through built-in bias, through selective impingement on areas of the pattern, through harmonic pattern initiation, through pantographic symbiosis, and by mechanical pantographic means.

BRIEF DESCRIPTION OF THE DRAWINGS

These and other features and advantages of the present invention will become apparent from consideration of the following specification when taken in conjunction with the accompanying drawings in which:

FIGS. 1–5 illustrate variations of single system tessellation folding patterns;

FIG. 6 illustrates a generalized dual system folding pattern;

FIG. 7 illustrates a particular dual system folding pattern which will completely collapse;

FIGS. 8 and 9 are perspective views showing dual systems designed for complete collapse and for partial collapse respectively;

FIG. 10 illustrates a dual system folding pattern wherein the lines of one of the systems are continuously straight;

FIGS. 11–14 illustrate additive and subtractive folding;

FIG. 24 is a schematic representation showing the degradation of the pantographing folding response;

FIG. 25 is a schematic illustration of impingement initiation of folding;

FIG. 26 is a cross-sectional view showing one form of impingement for initiation of folding;

FIGS. 27–29 show various means of applying generalized pressure on one side of a pallet;

FIGS. 30–40 illustrate initiation of folding by harmonic pattern conjugation;

FIG. 41 illustrates a plurality of tiles made in accordance with the present invention fully nesting;

FIG. 42 is similar to FIG. 41, but showing tiles that are only partially nesting;

FIGS. 43 and 44 are schematic illustrations showing the use of a vacuum to hold, and to assist in initiating folding, of tiles or the like;

FIG. 45 is a front elevational view of a comb for spatially proofing the folding of an unconjugated harmonic pallet prior to initiating the folding of the pattern;

FIG. 46 illustrates the technique of using an unconjugated harmonic syndetic pallet to tessellation fold a sheet material;

DETAILED DESCRIPTION OF THE EMBODIMENTS

Figure 14:
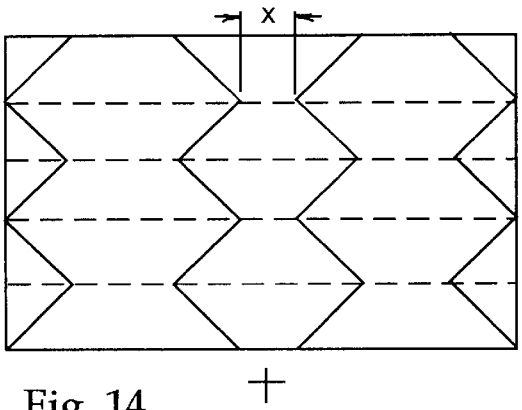

Referring now more particularly to the drawings, and to those embodiments of the invention here presented by way of illustration, some background will first be presented for a full understanding of the present invention.

The following is a list of definitions of words used in the present specification. Some of the words are normal English words, and others are words applied to the present technology by the inventor where no word previously existed for the precise meaning needed.

Definitions

1. Tessellation (to tessellate, tessellated). The word is from the Latin "tesselatus" applied initially to surface patterns involving small squares, forming a checkerboard pattern, as in mosaics. In modern usage the word refers generally to repeat patterns on a surface.

2. Tessellation Pattern Folding. Repeat patterning generated on the surface of a membrane by multiple folding.

3. Syndetic Pattern Folding. Although synonymous with tessellation folding, syndetic folding applies particularly to tessellating pattern folding in which CPR is inherent. CPR is not inherent in all tessellating pattern folding, e.g. in pleating.

4. Syndetic. From the Greek word "syndeticos" meaning "a binding together". When CPR is involved in tessellation pattern folding, elements of the pattern cannot be folded independently of others; theoretically all the elements of the pattern must be folded together, simultaneously.

5. Compound Pantographic Response (hereinafter referred to as CPR). Three-dimensional structures built up of single pantographic linkage elements which respond as a whole to the movement of any one of its linkages (an umbrella structure is a well-known example).

6. CPR Degradation. Whereas a CPR structure made up of rigid elements and pivot-type hinges can theoretically be extended indefinitely, one made up of flexible linkages and membraneous hinges, by way of cumulative inexactitude, degrades with increasing distance from the locality where folding is taking place, and finally disappears altogether.

7. CPR Symbiosis. In effect, the converse of CPR degradation. In a circumstance wherein an unfolded portion of a continuous belt, capable of being syndetically folded, passes continuously towards a region where pattern folding is taking place, it initially comes under the influence of the residual forces of CPR degradation emanating from the folded region. As the belt continues to advance, the CPR degradation forces applied to it increase. The belt passes into a gradually increasing CPR force field, which can be viewed as CPR symbiosis force emanating upstream from the folding zone.

8. Membrane. A generic usage, implying thin, membraneous materials of various kinds, such as papers, fabrics, plastics, cementitious materials and others, occurring as flat or curved forms.

9. Master Sheet. Traditionally, membranes to be tessellation folded have been placed conjugatively (i.e., face to face) between two open, but previously tessellated pattern folded, sheets of relatively stiff paper. The "sandwich" is then folded as a whole in order to impart the folding wanted to the membrane. Such stiff paper sheetings have been descriptively referred to in the past as "master sheets".

10. Nesting Tessellation Patterns. In the circumstance wherein two conjugatively placed master sheets, folded together to form a tessellation pattern, remain everywhere in contact throughout the folding operation, the pattern is a nesting one. Not all tessellation folding patterns are nestable; in the non-nesting patterns, the two master sheets separate at various localities during folding. Thus, the two master sheet principle of tessellation folding is not universally applicable. A single master sheet must be used to form non-nestable patterns.

11. Syndetic Pallet. Precisely engineering a master sheet, with uniformly flexible hinges and rigid facets, enhances its CPR and makes it respond predictably and sensitively to external forces applied to make it fold. Master sheets of this type were made initially for making concrete roof tiles. In the concrete roofing tile industry, the tiles are formed on molding trays known as pallets. When applied to tile making, these master sheets replace the pallets, but perform a similar function, and thus came to be referred to as "syndetic pallets". The name has been retained for master sheets of this type used in other applications.

12. Facet. The flat, rigid parts (most often rhombic in shape) of a syndetic pallet, bounded at each edge by hinges, are referred to as facets. Because of this usage, the corresponding parts of both syndetic pallet layouts and of the membrane foldings themselves, have become known as facets. In a syndetic pallet, the facets perform as the linkage components of a CPR mechanism; and, for this function, the more rigid they are, the better.

13. First, Second and Third Forces. A syndetic pallet, even though precisely made with rigid facets and uniformly flexible hinges, loses its inherent folding capability when fully opened out. In contrast, a link chain type of CPR structure never loses its CPR folding ability as its hinges prevent full opening. To restore CPR ability to a fully opened syndetic pallet, small, selectively applied deflection forces have to be applied simultaneously to both sides, generally perpendicularly to the pallet to induce a multiplicity of positive and negative deflections across the pallet. Thereafter, a transversely applied force is applied to the pallet to cause it to fold with CPR.

For descriptive and referential purposes, the two sets of positive and negative deflecting forces are referred to as "first" and "second" forces, though they are applied simultaneously. The transversely applied CPR pallet folding force is referred to as the "third" force.

14. Harmonic Conjugate: Besides using the applied "first" and "second" forces to induce a fully opened syndetic pallet to fold with CPR, there are other means. Among these is that of hingeably conjugating a fully open syndetic pallet with a partially folded harmonic pallet. Since the harmonic pallet remains partially folded when hinged to the fully open one, it retains its CPR. As a result, when the entire compound pallet structure is subjected to "third" force compression, the harmonic conjugate folds with compression and causes the fully open pallet to do so also. Although the folding pattern of the conjugating pallet is similar to that of the syndetic pallet, it must be designed specifically for its function. Essentially, however, its folding frequency minimally must be half that of the syndetic pattern, which is the origin of the term "harmonic".

15. Topless Conjugate Pallet. For certain types of syndetic patterns, a partially folded harmonic pallet by itself, without having a syndetic pallet conjugated with it, serves as a syndetic pallet. In this circumstance, the membrane material to be folded virtually replaces the syndetic pallet. Using "topless" in this context refers to using the pallet to conjugate a pattern, and not a physically existing syndetic pallet.

16. Syndetic Pattern Automorphic Device (SPAD). A mechanized syndetic pallet which is mounted and powered in a production machine setting. It can be finite in form (e.g. for making tiles, panels, finite space-enclosing shapes and the like), or it can take the form of a continuous belt for processing belt-type membranes. The word automorphic is from the Greek words auto for "self", and morphe for "form". A dictionary gives the meaning "marked by automorphism", the ascription to others of one's own characteristics. Contextual use of the word refers to using the syndetic pallet in production to transfer its folding pattern to membraneous materials.

17. Tessellation Folding Pattern Classification. As far as known, tessellation folding patterns have not been classified, and some knowledge of classification is essential to understanding material presented in the patent disclosure. In the disclosure, tessellation pattern folding is classified broadly into Single System, Dual System, Triple System, and by inference, Quadruple System etc., folding. "System" applies to systems of more or less parallel folding lines. Certain conventions are followed: folding line intersections are called folding foci; a folding line is a continuous line, whether straight or zig-zag, passing through a plurality of foci. Although not referred to in the patent disclosure, the folding lines can also be curvilinear.

Each classification can be subdivided into several subclasses, and these can appear together in particular patterns known as hybrid patterns. Hybrids can themselves be classified. CPR folding technology is generally applicable to all these patterns, though each pattern presents unique handling problems. The generality of application of CPR folding technology is stressed in the patent disclosure, but one of the difficulties encountered in doing so is that of avoiding becoming too deeply embroiled in discussions of pattern variability, while realizing that few people are aware of how broad the scope of variability is. For the same reasons, applications to space enclosing syndetic patterns, though alluded to, are sparingly discussed.

One aspect of pattern hybridization is of unique significance and is discussed. It concerns patterns embodying both single and dual (or single and triple) system folding. Single system tessellation folding has no CPR properties, whereas dual and triple system foldings do, and the folding mechanisms under consideration are CPR based. How to handle this matter is discussed; and, it is shown how uniquely single system syndetic pallets can be made to fold with CPR, thus making single system folding compatible with production machinery set up for CPR folding.

18. Racemic. Botanically, the division of a plant stem, followed by division of the divisions, etc., is known as racemerization. In the field of tessellation pattern folding, the word came into use in describing syndetic patterns that divide, and divide again, etc. Contextually the word is used in reference to syndetic pallet conjugation in which a harmonic conjugate is itself conjugated by another harmonic conjugate.

I. Single System Tessellation Folding Patterns

FIGS. 1–5 depict examples of single system tessellation pattern variations. In general therefore, plaiting can be defined as a tessellation folding pattern based on a single system of more or less parallel, but continuously straight, folding lines 10.

II. Dual System Tessellation Folding Patterns

Tessellation folding patterns of more particular interest are more complex than plaiting patterns. They are based on having two systems of more or less parallel folding lines crossing one another, either orthogonally or obliquely; more specifically, they can be defined as patterns in which four folding lines 11, 12, 13 and 14 meet at each folding focus 15, or intersection as shown in FIGS. 6–10. This form of tessellation patterning is often called "cross plaiting" on the basis of assuming that plaiting takes place independently in each system, and the tessellation pattern developed is an interference pattern generated by meeting of the two plaitings. But the assumption is not entirely valid because in folding, the two systems cannot be wholly independent of each other. Even so, as in single system patterning, the spacings and inclinations of the folding lines in each of the systems can be varied as depicted in FIGS. 1–5.

III. Triple System Tessellation Folding Patterns

Figure 15:
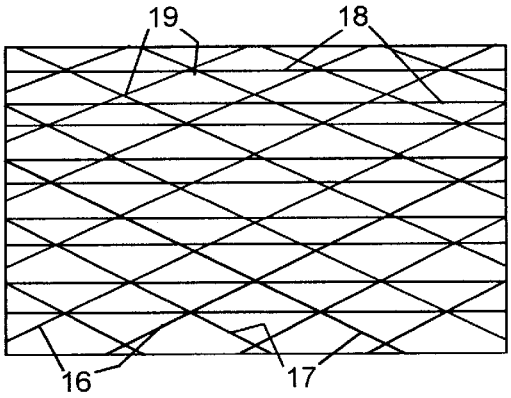
FIG. 15 illustrates an additive triple system folding pattern.

In triple system tessellation folding, three systems of parallel folding lines intersect. In FIG. 15, there are parallel lines 16, 17 and 18. Specifically, they can be defined as patterns in which six folding lines meet at each folding focus 19. Triple system pattern folding has not been studied as much as dual system pattern folding, and contextually discussion is mainly directed at dual system pattern folding. However FIG. 15 depicts a well known triple system tessellation folding pattern.

Technically, tessellation patterns involving more than three systems of more or less parallel folding lines are feasible, but are too complex for contextual consideration.

IV. Dual System Folding Line Interdependence

The folding collapse capability of a dual system pattern is dependent on the folding line intersecting angles of the two sets of lines. FIG. 6 depicts a generalized dual system folding pattern with both the system orientation, and intersecting angles indicated at $\alpha$, $\beta$, $\tau$and $\delta$. If the relationship of the four intersecting angles at each focus 15 is as indicated in FIG. 7, the tessellation folding will have the capability of collapsing completely. If not, complete collapse folding will take place along only one folding line, with only partial collapse taking place along the other folding lines. Partial collapse (or lock) folding thus developed, has aesthetic and functional merits which make it of no less significance in tessellation patterning than fully collapsible folding. FIGS. 8 and 9 depict fully collapsible and lock folding, respectively.

V. A Special Case

As may be seen in the generalized dual system pattern depicted in FIG. 6, none of the folding lines in either of the two systems is continuously straight, as in a single system plaiting pattern. However, the best known form of dual system pattern is a sub-classification pattern in which the lines of one of the systems are continuously straight. This type of pattern (subject to folding line spatial orientation and intercept angle variations) may take several forms. FIG. 10 depicts the simplest and best known form of it, lines 12 and 14 being straight, and lines 11 and 13 being zig-zag.

VI. Additive and Subtractive Repetitive Folding

Additive and subtractive folding, as well as combinations of both, are depicted in FIGS. 11–13. In single system patterning, additive folding is known generally as box-pleating. In dual system patterning, additive and/or subtractive folding may occur in only one of the systems or in both together. Patterns involving only subtractive folding as shown in FIG. 11 generate space filling entities which can be extended indefinitely, whereas those involving extended additive folding form finite space enclosing entities. Many patterns involving both subtractive and additive folding, as shown in FIG. 13, can, like wholly subtractive folding patterns, be extended indefinitely and be handled similarly. Space enclosing entities, however, incur design requirements unique to each pattern. Thus, although the general principles of the tessellation folding techniques considered below apply to all tessellation folding patterns, space enclosing patterns additionally have unique folding problems that may or may not be solvable.

FIG. 15 depicts a well known additive triple system folding pattern: it is a special case of the dual system pattern depicted in FIG. 14 in which the folding lines indicated by x in FIG. 14 are omitted.

VII. Curved Sheet Materials

The common term "sheet material" applies in general to thin materials having substantial superficial area, rather than to the flatness or shape of the sheet. A curved sheet material may take a variety of shapes, the simpler ones being cylindrical, conical and spherical. These shapes can also be developed from flat sheets by additive pattern tessellation folding; however, there are advantages in starting tessellation folding on an already shaped sheet. The advantages include: the use of less material; aesthetics; and circumvention of large movements which take place in forming the shape from a flat sheet.

Figure 16:
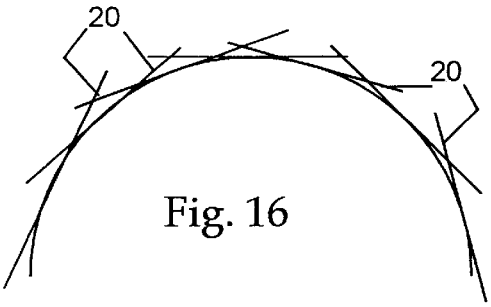
FIGS. 16–18 illustrate the approximation of various curved surfaces by a series of tangential facets.
Figure 17:
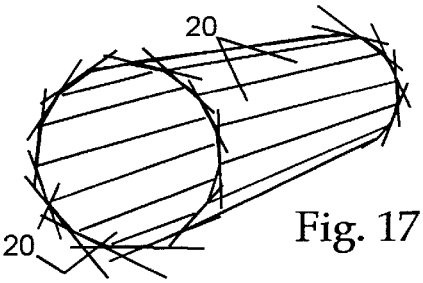
Figure 18:
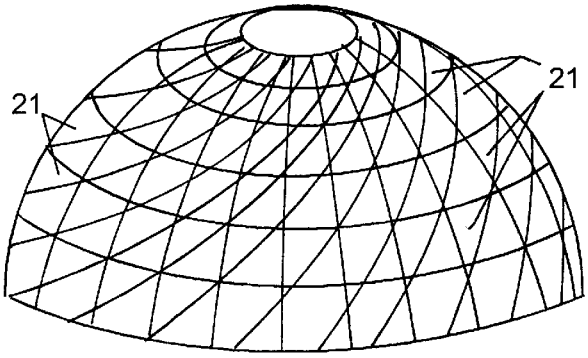

As is well known, curves can be approximated by a succession of tangents 20 (FIGS. 16 and 17), and curved surfaces by a mosaic of tangential facets 21 (FIG. 18). To enable dual system tessellation folding of curved sheet materials, the material must first be made to take up a faceted mode as depicted in FIG. 18. Thus, the general principles of the tessellation folding techniques considered below apply to curved sheet materials. Inevitably they are likely to be space enclosing entities, and thus subject to the same considerations and limitations cited above for space enclosing additive foldings.

VIII. Dual System Folding

As in single system pattern folding, the traditional craft folding practice used for dual system patterns involves placing the material to be folded conjugatively between two previously folded stiff paper master sheets, and manually folding the resulting sandwich. Also in the craft folding of fine dual system patterns in fabrics, the fabric is adhered to a single master sheet. After folding, the paper may be left on the fabric as a stiffener; or, if the glue used to adhere the fabric is soluble, the paper is removed. Master sheet mediated dual system manual folding is time consuming and quite difficult. A fundamental reason for the difficulty is discussed below in conjunction with pantographic symbiosis.

Dual system tessellation pattern folding, by placing a sheet material to be folded conjugatively between two master sheets (or in conjugative contact with one master sheet) to mediate folding, is a prior art of long standing traditional origins, but the prior art does not include means of folding patterns as follows:

(1) Continuously in one step from start to finish of the folding operation;

(2) In which neither folding system has continuously straight folding lines, making preliminary plaiting impossible;

(3) In which lock patterns are required as in FIG. 9;

(4) In which compound patterns, having both dual and single system patterning occur non-sequentially together.

A. TECHNICAL BASES

Pantographing

Figure 19:
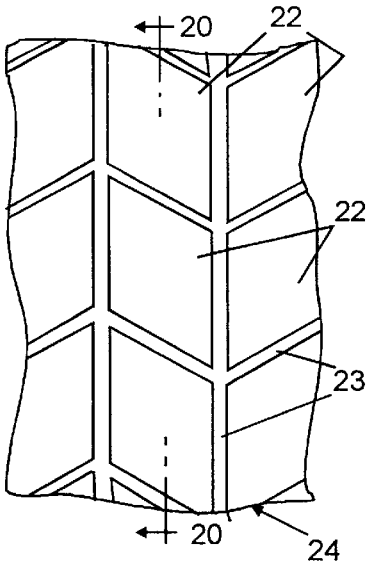
FIG. 19 is a top plan view of a syndetic pallet made in accordance with the present invention for use in practicing the method of the invention.
Figure 20:
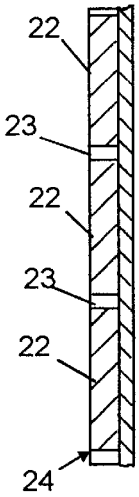
FIG. 20 is a cross-sectional view taken along the line 20–20 in FIG. 19.
Figure 21:
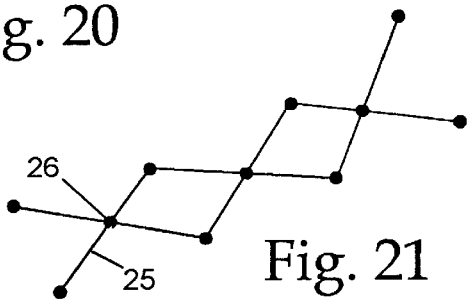
FIG. 21 illustrates a single system pantographic linkage system.
Figure 22:
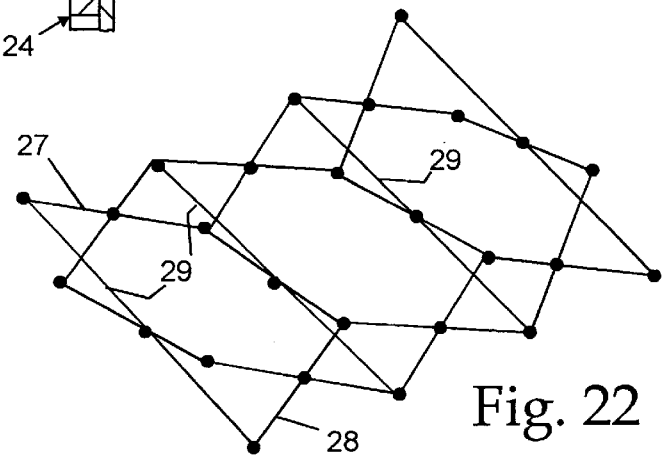
FIG. 22 illustrates a portion of a dual system pantographing linkage structure.

A dual system tessellation pattern folding master sheet as shown in FIGS. 19 and 20, having rigid facets 22 and flexible hinges 23, from the start of, and throughout folding, responds as a compound pantograph. A refined derivative of a stiff paper master sheet, precisely made, with truly rigid facets 22 and with uniformly flexible hinges 23 (hereinafter referred to as a syndetic pallet 24) transmits its pantographic responses predictably and with more sensitivity, uniformity and strength than a stiff paper version. FIGS. 21 and 22 depict a multi-element single system pantographic structure and a portion of a dual system compound pantographic linkage structure. It is well known that moving one element 25 about the pivot 26 in a single system pantographic chain causes the entire chain to extend or contract. A dual system compound pantographic structure can be assembled by cross-linking, with links 29, several single system pantograph chains 27 and 28 as in FIG. 22; obviously the structure can be continued in both directions. Thus, extending or contracting an element in only one of the chains 27 or 28, or link 29, causes the entire structure to respond both longitudinally and transversely.

Figure 23:
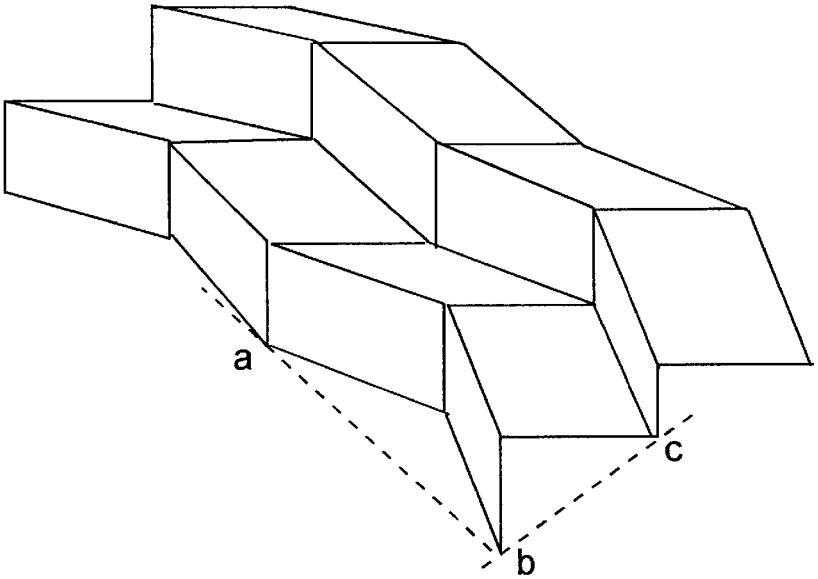
FIG. 23 is a schematic illustration showing how dual system tessellation folding responds as a compound pantograph.

FIG. 23 illustrates how a dual-system tessellation folding responds as a compound pantograph: when line a-b is extended or shortened, line b-c responds in the same way; these movements transmit throughout the entire folding.

Theoretically, compound pantographing structures, no matter how extensive they are, respond as a whole to locally applied tractions; but practically their range of pantographing effectiveness is limited by the flexibility of the hinges. In a flexibly hinged syndetic pallet 24, the compound pantographing folding response can be readily seen to degrade uniformly as the distance from the initiation locality increases. This is shown schematically in FIG. 24.

The relevance of these compound pantographing folding responses to the present invention is indicated by the following:

(1) It is the mechanism used to make one-step continuous dual-system tessellation folding possible, and it applies generally to an infinite variety of dual-system patterns, and also to known triple-system patterns.

(2) In applying compound pantographic folding to tessellation pattern folding, all, or a substantial portion of the material being folded must be subjected simultaneously to the folding action.

(3) Pantographic folding response degradation makes possible the application of syndetic pallets in a continuous folding operation. For example, a syndetic pallet having the form of a continuous belt can be continuously collapse-folded in one locality while remaining fully open elsewhere, thus allowing an unfolded sheet material to be continuously fed to it. This is discussed in more detail hereinafter.

Initiation

A dual-system tessellation pattern master sheet responds from the start of folding as a compound pantograph. When fully extended however, a well-hinged master sheet theoretically contains no intelligence as to the pantographic folding responses desired; and, if lateral traction is applied to the master sheet to induce folding, some of its hinges will butt, some will fold upwards, and others downwards responding to various random local tractions. Taken together, these responses cause chaotic folding. A stiff paper master sheet, in which the hinges are foldings, retains a weak folding bias and can be expected to respond to folding less chaotically than a precise, uniformly and flexibly hinged, bias free syndetic pallet 24. However in a mechanical setting, chaotic folding responses in any part of a master sheet, however minor, are unacceptable. Thus in a fully extended syndetic pallet 24, externally applied forces for initiating compound pantographic folding response are required, and the forces must be applied in accordance with knowledge of the folding pattern.

Bias Initiation

Hinge folding bias can be incorporated in a syndetic pallet through elastomeric bias in the hinges. One method for providing such bias is to coat the hinges 23 of a pallet 24 with an elastomeric latex, and to allow the latex to cure while holding the syndetic pallet 24 in a folded state. As an initiator, it has been found that integral bias works reliably over only a small area; and, in some circumstances, that it militates against fully opening a syndetic pallet. It is considered best applied to small pallet areas, and adjunctively with other means of initiation.

Selective Impingement Initiation

The deflections, and deflection forces, required to initiate compound pantographic folding in a pallet 34 are quite small, but have to be applied generally perpendicularly to the pallet, selectively to suit the pattern. FIG. 25 illustrates the principle of impingement initiation using probes, the points designated at 51 being top-side probes for exerting a first force, and the points designated at 52 being bottom-side probes for exerting a second force. FIG. 26 depicts probes 30 impinging from one side only for exerting the second force, with the weight of the material being folded acting as the first force indicated by the arrow 31.

In FIG. 26, it will be seen that the pallet 24 is supported on a platform 32 defining holes 33 therein. As the probes 30 are raised, discrete points, or hinges 23, will be lifted while the weight of the material holds down the hinges 23 that are not specifically lifted. Folding is thereby initiated.

This arrangement works in initiating folding of heavy concrete-type sheet material; however, there are other effective means for applying generalized pressure on one side of a pallet 24, and some examples are shown in FIGS. 27 to 29.

FIG. 27 shows a foamed elastomeric material or other compliant material having a lower surface 34 in a zig-zag line. As shown, there is a plurality of vertical slits 35 to allow each portion of the device to deflect easily. Thus, the lowest points 36 can exert a downward, or first, force on selected hinges 23 to begin folding of a pallet 24. FIG. 28 shows a similar device, but the device is an inflatable member rather than foamed but is still compliant. FIG. 28 shows the low points 36*a* on a zig-zag lower surface 34*a*. FIG. 29 illustrates the use of a gas stream, such as air. In FIG. 29, there is a fan 36 which generates a stream of air as indicated by the arrows 37. Thus, the devices shown in FIGS. 27, 28 and 29 provide downward forces, or first forces, for use in initializing folding of a pallet 24.

Since the initial deflection required for initiating folding is small, the pallet does not shorten appreciably either longitudinally or transversely; therefore probes 30, 36, 361 etc. touching the pallet do not interfere with initiation. But when the subsequent folding collapse begins, lateral movement of the pallet becomes quite large, and the probes have to be removed before collapse folding can begin. Thus in practice, the probes from the top or bottom have to be applied with a jabbing motion in conjunction with beginning the collapsing operation.

Having a fold initiation step precede folding does not make the folding process a two-step operation, as collapse folding is a continuation of the folding induced by the fold initiation step. It will therefore be understood that, as soon as the folding has been initiated by the forces exerted generally perpendicularly to the pallet, the third forces will be exerted laterally of the pallet to continue the folding until the pallet has been folded as desired.

Initiation By Harmonic Pattern Conjugation

Figure 30:
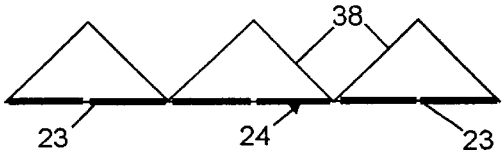
Figure 31:
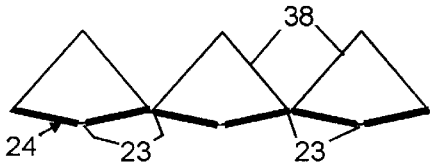
Figure 32:
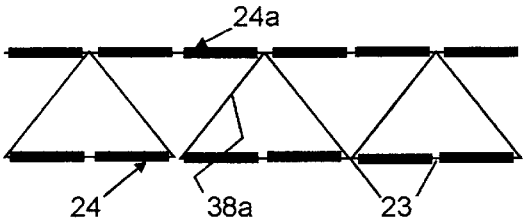

A dual-system tessellation pattern may be considered to be one of an infinite series of patterns, any one of which, when partially collapsed, harmonizes with others having a different degree of collapse. Evidently therefore, partially collapsed patterns that harmonize with fully extended ones can be designed. This matter is clarified in FIGS. 30 and 31 which depict harmonic pattern conjugation. FIG. 35 depicts a dual-system syndetic pallet harmonically conjugated in this way. Since the harmonic component 38 of the pallet 24 remains in a state of partial collapse when the other component is fully extended as shown in FIG. 30, initiation is not required to make it fold as a compound pantograph as shown in FIG. 31, thereby providing integral pallet folding initiation intelligence. FIG. 32 depicts a double faced conjugated syndetic pallet having pallets 24 and 24*a*, with harmonic component 38*a*. It can be used to mediate folding simultaneously on both faces, or for structural or other operational reasons.

Figure 33:
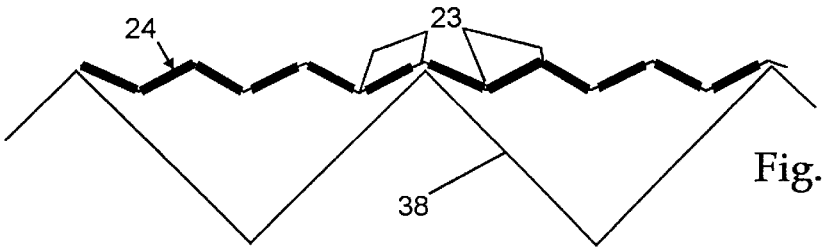
Figure 34:
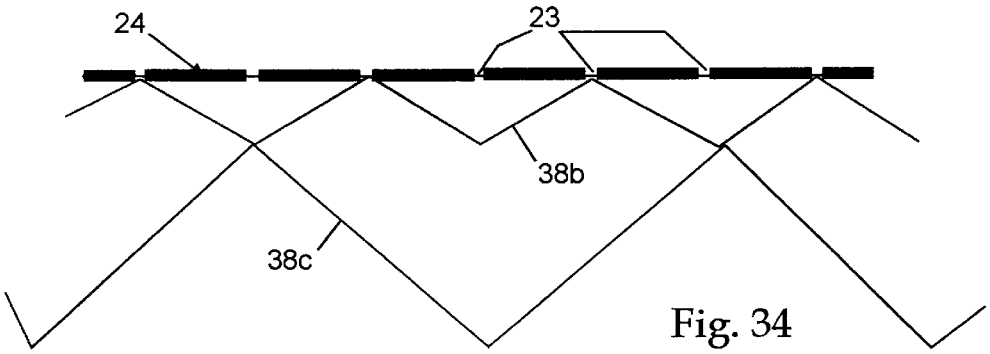

FIG. 33 depicts a syndetic pallet 24 with racemic conjugation. This arrangement may be used for reasons of constructional economy, or in the circumstance wherein a fine (i.e., high count) tessellation folding pattern is desired. On a fine pattern pallet, double racemer conjugation may be used to facilitate the mounting of actuation devices such as the harmonic component 38.

FIG. 36 depicts a single cell of a harmonically conjugated pallet having pallet 24 and harmonic component 38 in two partially collapsed forms. The two partially collapsed forms arise because conjugation does not furnish all of the intelligence needed to make folding take place. Thus an adjunctive source of intelligence for selective initiation is needed. The intelligence can be effectively furnished by inherent bias as discussed above, which as noted is best applied to only small pallet areas. Adjunctive initiation can also be furnished by closing off the ends of each cell in a syndetic pallet, and applying either compressed air or vacuum to each cell to initiate outward or inward folding (See FIG. 43). In racemic harmonic conjugation as illustrated in FIG. 37, having adjunctive bias is essential.

FIG. 40 depicts another, but significant, means of initiating inward folding. Here, by placing the sheeting 39 to be folded between a smooth platen 54 and the pallet 24, when the harmonic component 38 is collapsed, only inward folding of the pallet 24 and sheeting 39 can take place.

Mechanical Linkage Pantographic Initiation

Harmonic pattern conjugation is best suited for small to fine (high count) tessellation folding patterns. Coarse (low count) pattern syndetic pallets readily allow for the integral attachment of mechanical linkage pantographic chains as shown in FIGS. 21 and 22, which furnish initiation folding intelligence in the same manner as harmonic pattern conjugation. FIGS. 38 and 39 depict such an arrangement, respectively with the pallet 24 fully open and partially collapsed. The mechanical linkage chains 40 have to be actuated conjointly, and further can continue to collapse, hence used to provide the force required to complete the tessellation folding.

A single-system pattern syndetic pallet, whether harmonically conjugated or not, does not fold as a whole pantographically, but it can be made to do so by integrally mounting pantographic linkage chains such as the chains 40. This is of particular significance because many tessellation folding patterns combine single- and dual-system folding. In compound patterns wherein the single and dual system patterns are interlocking (e.g. in skip row types of patterns) compound pantographing takes place throughout. But in those where single and dual system patterning occur sequentially, compound pantographic symbiosis emanating from the dual system portion, mediates folding at one end of the single system portion, but the folding degrades with increasing distance from the dual system portion. Thus, by adding integrally mounted linkage chains to positions along the length of the single system portion, folding along the entire length can be uniformly applied.

Pantographic Symbiosis Activation

Figure 49:
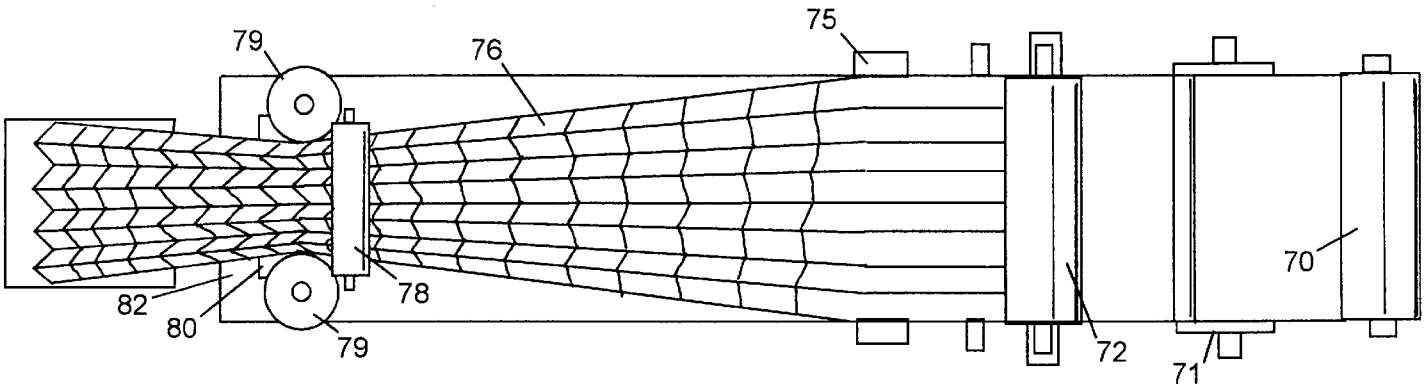
FIG. 49 is a top plan view of an apparatus for continuous tessellation folding; and, FIG. 50 is a side elevational view of the apparatus shown in FIG. 49.
Figure 50:
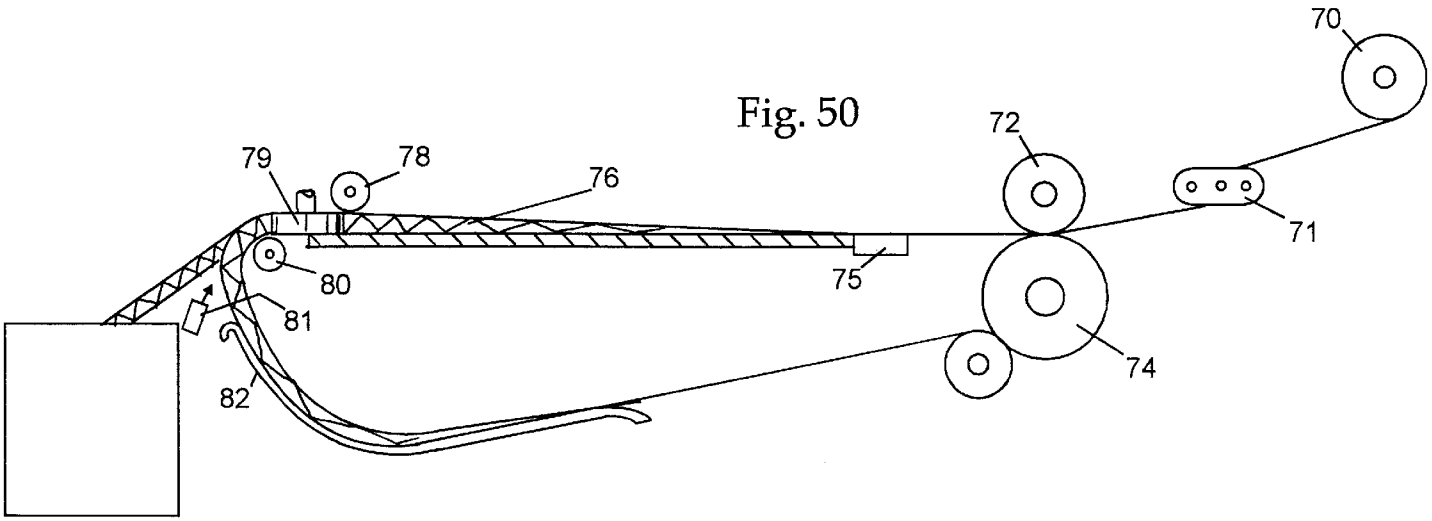

In continuous belt folding as depicted in FIGS. 49 and 50, pantographic folding degradation allows the oncoming, but as yet unfolded, part of the pallet (along with the sheeting to be folded), gradually to enter the pantographic symbiosis field extending forward from the folding zone. The uniformly applied, gradually increasing symbiosis forces initiate pantographic folding in the pallet. The aforementioned fundamental difficulty encountered in manually folding dual-system patterns arises because the pantographic symbiosis forces emanating from the comparatively small manual folding zone are locally severe and unevenly applied to the as-yet-unfolded surrounding material. This causes local buckling which militates against the folding wanted in the surrounding material. This will be discussed further herein below.

B. SYNDETIC PALLET APPLICATION

The utilization of two master sheets made of prefolded stiff paper or like materials to mediate the tessellation folding of a sheet material conjugatively placed between them is prior art, as is the use of a single master sheet to tessellation fold a sheet of material conjugatively held in contact with it. While the substitution of such master sheets by a precise, uniformly hinged, rigid faceted, well engineered version of it, is not of itself conceptually significant, doing so does have substantial significance in application. In a syndetic pallet, compound pantographic folding, which makes one step folding feasible, becomes a fully predictable, sensitive and mechanically strong folding response. This, together with mechanical adaptability, makes a syndetic pallet 24 suitable for application in a production machine setting, where it becomes a repetitive, power operated, one step folding die. Contextually applied in this way it is referred to as a Syndetic Pattern Automorphic Device, or SPAD.

Twin Pallet Disconjugation

In operating a conjugating pair of syndetic pallets when folding a particular dual system pattern on uncured gypsum sheetings, severe suction-stippling type markings appeared on one face of the foldings, whereas using the same pallets to fold paper had no noticeable effect on the foldings. Close observation showed that the pallets were separating (disconjugating) slightly during the later stages of folding. The cause was found to lie in the fact that not all tessellation patterns can be fully nested. As is illustrated in FIG. 42, the pallet will pull away from the material being folded in that area 41. Thus, employing two syndetic pallets together to mediate tessellation folding is not a universal option.

A Single Syndetic Pallet

Using one syndetic pallet 24 in place of two to mediate tessellation folding is a simplifying step, but it introduces unique attributes and procedural requirements.

Contact Conjugation

The material to be folded can be held against the pallet by various means. Pressing the material between the pallet 24 and a smooth table top or platen 42 is depicted in FIGS. 27–29. FIG. 35 depicts the application of vacuum to a harmonically conjugated pallet 24. By perforating the pallet as in FIGS. 43 and 44, the vacuum can be used to hold the material in contact with the pallet. FIG. 43 depicts a portion of the cell formed between the pallet 24 and a conjugating harmonic pallet 38, and closing off the ends of the cell to enable its use as a vacuum manifold. FIG. 44 depicts attaching flexible plastic tubes 43 to the underside of the perforations in the pallet 24 to apply vacuum.

Topless Harmonic Conjugation

The procedural arrangement depicted in FIG. 40 has a variant application which introduces a unique and useful means of tessellation folding depicted in FIG. 46. Here the sheet material to be folded is held between a smooth table top or platen 54, and a partially folded syndetic pallet 55. The partially folded pallet 55 is now collapsed, causing the sheet material to fold harmonically. Varying the degree of initial folding in the pallet 55 varies the amplitude of the harmonic folding in the sheet materials proportionately. The material grabbing effectiveness of the pallet can be enhanced by attaching grit or short needle points to the pallet hinges 23 which come in contact with the material for temporarily fixing the pallet to the sheet material. In this arrangement, the material to be folded replaces the pallet component of a conjugated pallet. The folding technique is very effective for folding papers and fabrics; and, with heat setable fabrics, a heated platen 54 is effective for heat setting the folds.

Application

In folding sheet material, a syndetic pallet can be operated in three ways:

1. A sheet of material, conjugatively in contact with a fully extended syndetic pallet, is folded to complete collapse. It should be noted that lock pattern collapse as shown in FIG. 7 is also a form of complete collapse.

2. A sheet of material, conjugatively in contact with an open syndetic pallet, is folded to a state of partial collapse by limiting the degree of collapse wanted.

3. A sheet of material, conjugatively in contact with a partially collapsed pallet, is folded to complete collapse.

The fully open and fully collapsed states of a pallet are precisely defined whereas all partially collapsed states are not. In applications where precise, partial collapse, spatial uniformity is needed, spatial proofing means are needed.

FIGS. 45 and 46 illustrate the use of a spatial proofing comb 44 (FIG. 45). The comb 44 defines notches 45 to receive the partially folded facets of the pallet 55. When the pallet 55 matches the notches 45, the degree of collapse of the pallet 55 will always be the same.

Figure 47:
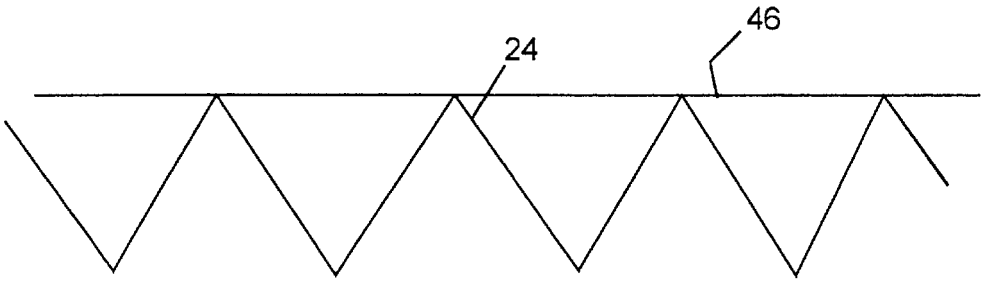
FIG. 47 illustrates an alternative method of spatially proofing an unconjugated harmonic pallet prior to initiation folding.

FIG. 47 depicts apparatus using a stretch limiting membrane 46 to furnish spatial proofing. The pallet 24 cannot open further when the membrane 46 is taut.

Stops integrally mounted on a pallet, and also integrally mounted pantograph linkages as in FIGS. 38 and 39, can be used to proof partial collapse. A proofing technique which is being applied in making tessellation folded concrete tiles involves depositing the folded but as yet uncured tiles into precisely shaped holders in which they cure. Its use in a production setting is shown in FIG. 48 and will be discussed in more detail below.

C. MACHINE APPLICATIONS

Figure 48:
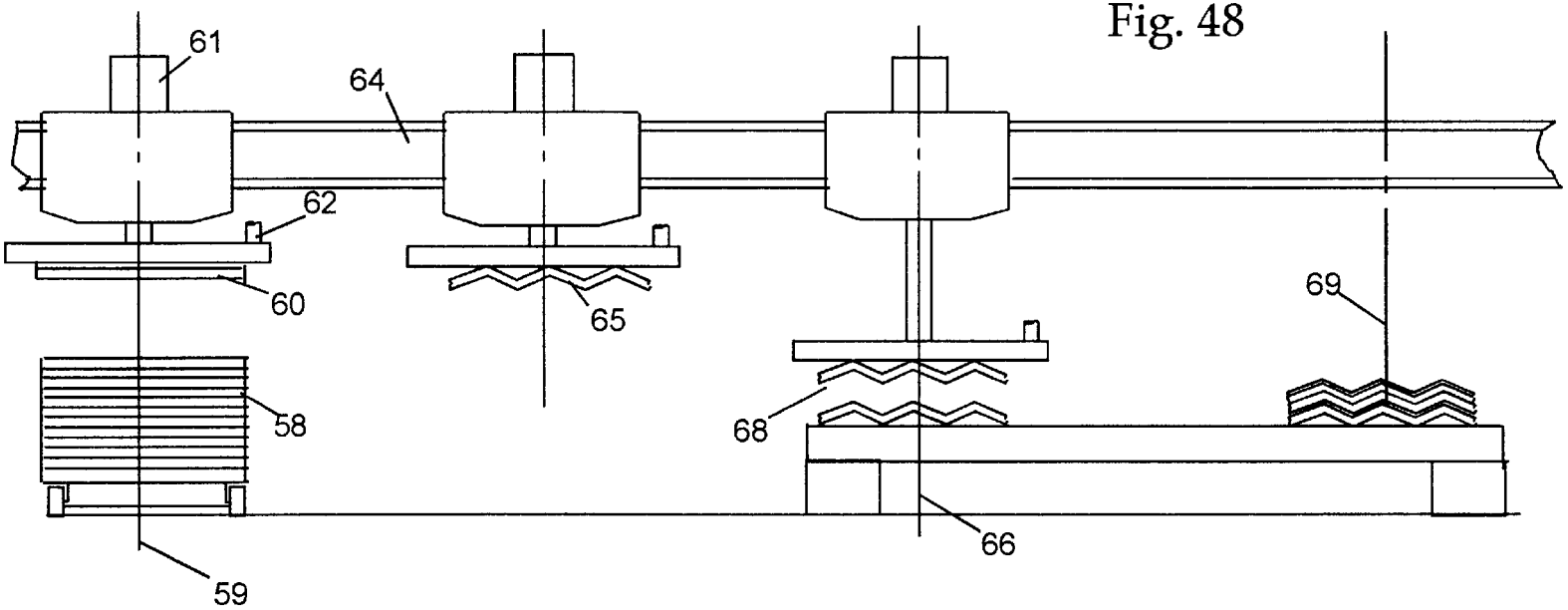
FIG. 48 is a front elevational view showing apparatus for making tiles using the tessellation folding of the present invention.

Two one-step tessellation folding machine applications are depicted in FIGS. 48, 49 and 50. FIG. 48 shows a machine for producing tessellation folded concrete tiles, panels and the like. FIGS. 49 and 50 show a machine for continuously tessellation folding sheet material.

Concrete Tile Machine

One-step tessellation folding makes it possible to tessellation fold uncured sheeted concrete, gypsum or other cementitious materials. After the sheets are folded, they are placed into holders which both proof and maintain their folded form while curing takes place. The microprocessor mediated machine depicted in FIG. 48 is suitable for slow-curing cementitious materials such as concrete, and for tessellation folding patterns which are fully nestable.

Referring to FIG. 48, a stack of uncured concrete sheets 58, each lined with a release paper, is placed in register position 59 of the machine. A SPAD 60, with its syndetic pallet fully extended, is lowered by means of power jack elevator 61, until it contacts the topmost sheet of the stack 58. Vacuum is then applied to the SPAD through the inlet 62, causing the topmost sheet to be urged against the open pallet. The SPAD 60, carrying the topmost sheet with it, now elevates and begins to travel along the rail 64. While traveling, the SPAD 60 activates, causing the pallet and vacuum-held sheet to tessellation fold as shown at 65. On reaching register position 66, traveling stops and the SPAD 60 de-elevates to a position of close proximity to a proofing holder 68. The vacuum is now cut off, allowing the folded sheet to be deposited into the proofing holder 68, or on an already deposited folded sheet. The SPAD 60 re-elevates and returns to register position 59, and the cycle repeats, building up a stack of folded sheets at position 66. There is a completed stack of folded sheets at position 69 ready to be removed and replaced by an empty proofing holder so that a new stack can be started as soon as the stack at position 66 is completed. Folded sheet curing takes place in the stacks in which they are deposited.

Continuous Tessellation Folding

A continuously fed sheet material can be continuously tessellation folded in a one step folding operation by a syndetic pallet. To do so, the pallet must be capable of undergoing fully collapsed tessellation folding in one locality while remaining fully open in another. This can obviously be done in a syndetic pallet mediating the folding of a single system (plaiting) pattern; but, dual system syndetic pallet folding incurs compound pantographing, so use has to be made of compound pantographing response degradation, which allows the pallet to fold completely in one locality while remaining open elsewhere. Thus, a syndetic pallet in the form of a belt is needed. The machine depicted schematically in FIGS. 49 and 50 utilizes a syndetic belt for continuously folding a dual system tessellation pattern on a continuously supplied sheet material. The machine depicted is designed to handle a sheet material of relatively narrow width; but with suitable drive adaptations, a syndetic belt pallet can also be designed to tessellation fold wide sheet materials. Additionally, with suitable adaptations a syndetic pallet belt can be applied to folding both single system and combination single/dual system patterns.

In FIGS. 49 and 50, the continuous tessellation folding machine is shown in plan and elevation respectively. A roll of sheet material is designated at 70 and supplies the machine continuously through a suitable web tensioner 71. The material, along with the fully open syndetic pallet, is fed into the machine by nip rolls 72 and 74. A suction box 75 extends across the web. The suction box 75 applies suction, by way of perforations in the pallet, to the sheet material, holding the sheet material firmly against the pallet as it passes into the region 76 which is the entrance portion of the belt.

It will be understood that the rolls 79 exert a constant force, or opposed forces, laterally of the belt, urging the edges of the belt inward, to collapse the pallet. There is therefore a lateral line across the belt that is fully folded. Since this portion of the pallet is always folded, the portions of the belt entering the zone 76 receive the information and are folded properly. In the area directly between the rolls 79, the material 70 being folded is fully folded, and the compressed pallet and fully folded sheet material debouch from the compression zone over roll 80 and begin to open out to define and unfolded exit portion of the belt. Air jets 81 separate the folded sheet material from the pallet, allowing the sheet material to fall into a container. Meanwhile, the pallet falls into a scree type receiver 82 in which its folding further dissipates, allowing the belt to open out and pass into the nip between rolls 84 and 74. For continuously setting tessellation folding in fabrics the arrangement depicted allows for recourses such as having the fabric prewetted with sizing or crosslinking chemicals, and for heating at the compression zone (which can, if necessary, be extended to increase the compressed folding residence time) and the like.

From the foregoing discussion it will be understood that the present invention provides a method and apparatus for carrying out one-step tessellation folding in a variety of sheet materials. Since the method of the present invention utilizes natural phenomena, the apparatus is much simpler than the prior art folding apparatus to accomplish quite elaborate folding. It will be realized that the specific folding patterns herein depicted are for purposes of illustration only, and many other patterns are possible in accordance with the description of the principles involved.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

What is claimed as invention is:

1. A method for the tessellation folding of sheet material, wherein said sheet material is placed in contact with a pallet having a plurality of flat rigid segments connected by hinges, said hinges including a plurality of non-parallel hinges, and said pallet is caused to fold selectively along at least some of said hinges including said non-parallel hinges, said method comprising the steps of initiating folding along said at least some of said hinges including said non-parallel hinges, said step of initiating folding comprising the steps of applying a first force in a first direction perpendicular to said pallet for causing a first group of said hinges to start to fold in a first direction, simultaneously applying a second force in a second direction perpendicular to said pallet for causing a second group of said hinges to start to fold in a second direction, and continuously applying a third force laterally of the pallet as a whole to continue tessellation folding to completion.

2. A method as claimed in claim 1, wherein the said steps of applying a first force and a second force are carried out by conjointly actuating pantographic linkage chains fixed to said pallet.

3. A method as claimed in claim 1, wherein the said step of applying a first force in a first direction comprises the step of urging a compliant material against said sheet material.

4. A method as claimed in claim 1, wherein the said step of applying a first force in a first direction comprises the step of directing at least one stream of fluid against said sheet material.

5. A method as claimed in claim 2, wherein the said step of applying a third force is carried out by continuing the said step of conjointly actuating pantographic linkage chains.

6. A method as claimed in claim 2, and further including the step of proofing said folding of said sheet material, said proofing comprising the steps of fixing a membrane to said second pallet in said partially folded condition and moving said second pallet between a fully folded condition and the partially folded condition limited by said membrane.

7. A method as claimed in claim 1, wherein the said step of applying a first force comprises the step of biasing said first group of hinges to hinge in said first direction, and simultaneously biasing said second group of hinges to hinge in said second direction.

8. A method as claimed in claim 1, and further including the step of proofing said folding of said sheet material to assure uniformity of said folding.

9. A method for the tessellation folding of sheet material wherein said sheet material is placed in contact with a first pallet having a plurality of flat rigid segments connected by hinges, said first pallet including a plurality of non-parallel hinges, and said first pallet is caused to fold along said hinges including said nonparallel hinges, said method comprising the steps of placing said first pallet in its fully extended condition, attaching to said first pallet a second pallet having a related pattern, said second pallet being partially folded so that all hinges of said second pallet are aligned with all hinges of said first pallet, exerting forces on said second pallet to continue folding said second pallet, and thereby exerting cognitive forces on said first pallet for folding said first pallet and said sheet material.

10. A method as claimed in claim 9, and further including the step of biasing at least some of the hinges of said first pallet for assisting in the desired folding of said first pallet.

11. A method as claimed in claim 9, and further including the step of placing said sheet material against a surface for limiting the direction of folding of said first pallet.

12. A method as claimed in claim 9, and further including the step of temporarily fixing the hinges of said first pallet to said sheet material to assure folding of said sheet material.

* * * * *